US006863774B2

(12) United States Patent
Cooper et al.

(10) Patent No.: US 6,863,774 B2
(45) Date of Patent: Mar. 8, 2005

(54) POLISHING PAD FOR USE IN CHEMICAL-MECHANICAL PLANARIZATION OF SEMICONDUCTOR WAFERS AND METHOD OF MAKING SAME

(75) Inventors: Richard D. Cooper, Sullivan, IN (US); Paul Fathauer, Sullivan, IN (US); Angela Mroczek-Petroski, Crawfordsville, IN (US); David Perry, Crawfordsville, IN (US); James J. Petroski, Crawfordsville, IN (US)

(73) Assignee: Raytech Innovative Solutions, Inc., Sullivan, IN (US)

( * ) Notice: Subject to any disclaimer, the term of this patent is extended or adjusted under 35 U.S.C. 154(b) by 237 days.

(21) Appl. No.: 10/087,223

(22) Filed: Mar. 1, 2002

(65) Prior Publication Data

US 2002/0127862 A1 Sep. 12, 2002

Related U.S. Application Data

(60) Provisional application No. 60/274,121, filed on Mar. 8, 2001.

(51) Int. Cl.[7] ..... D21H 27/00

(52) U.S. Cl. ..... 162/100; 162/135; 162/136; 162/141; 162/146; 162/194; 162/201; 162/202

(58) Field of Search ..... 162/100, 135, 162/136, 141, 146, 194, 201, 202

(56) References Cited

U.S. PATENT DOCUMENTS

| | | | | |
|---|---|---|---|---|
| 3,499,250 | A | 3/1970 | Jensen et al. | |
| 3,504,457 | A | 4/1970 | Jacobsen et al. | |
| 4,728,552 | A | 3/1988 | Jensen, Jr. | 428/91 |
| 4,814,680 | A | 3/1989 | Hulsing | 318/561 |
| 4,927,432 | A | 5/1990 | Budinger et al. | 51/298 |
| 5,257,478 | A | 11/1993 | Hyde et al. | 51/131 |
| 5,489,233 | A | 2/1996 | Cook et al. | 451/41 |
| 5,578,362 | A | 11/1996 | Reinhardt et al. | 428/147 |
| 5,605,760 | A | 2/1997 | Roberts | 428/409 |
| 5,769,691 | A | 6/1998 | Fruitman | 451/41 |
| 5,900,164 | A | 5/1999 | Budinger et al. | 216/88 |
| 6,022,264 | A | 2/2000 | Cook et al. | 451/37 |
| 6,022,268 | A | 2/2000 | Roberts et al. | 451/548 |
| 6,217,434 | B1 | 4/2001 | Roberts et al. | 451/548 |
| 6,280,290 | B1 | 8/2001 | Birang et al. | 451/6 |
| 6,287,185 | B1 | 9/2001 | Roberts et al. | 451/548 |
| 6,293,852 | B1 | 9/2001 | Roberts et al. | 451/41 |
| 6,300,247 | B2 | 10/2001 | Prabhu | 438/691 |
| 6,300,255 | B1 | 10/2001 | Venkataranan et al. | 438/787 |
| 6,383,066 | B1 | 5/2002 | Chen et al. | 451/532 |

FOREIGN PATENT DOCUMENTS

| | | |
|---|---|---|
| EP | 1118432 | 7/2001 |

*Primary Examiner*—Peter Chin
(74) *Attorney, Agent, or Firm*—Much, Shelist, Freed

(57) ABSTRACT

A polishing pad for use in chemical mechanical polishing of substrates that being made of fibrous matrix such as cellulose with a binder consisting of thermoset resin material, such as phenolic resin. The polishing surface is ground to form asperities. The polishing pad provides a porous structure by which polishing slurry and polishing debris during chemical mechanical polishing of substrates are stored for subsequent rinsing away, and for enhanced flow-distribution of the polishing slurry. Also disclosed is a method of making the polishing pad.

1 Claim, 5 Drawing Sheets

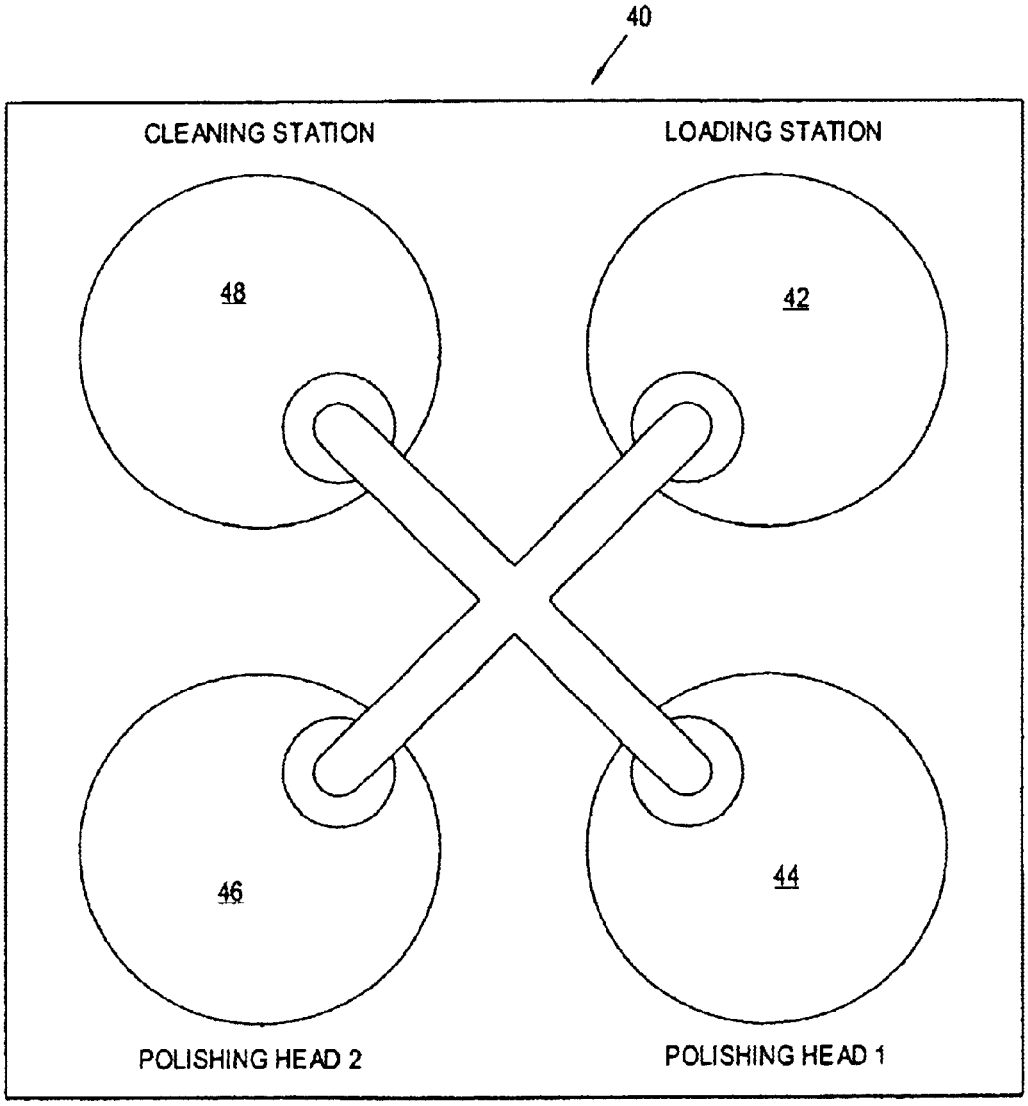
FIG. 3 - MULTIPLE HEAD CMP MACHINE

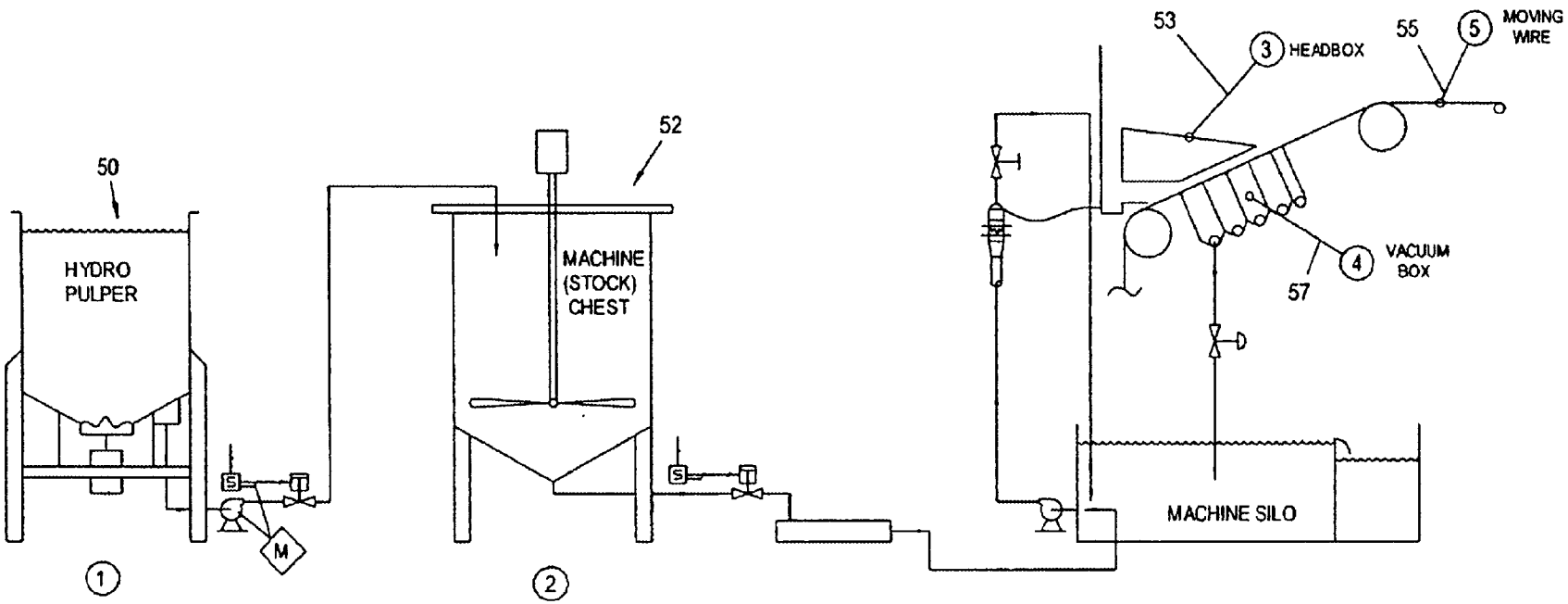
FIG. 4 - TYPICAL INCLINE WIRE MACHINE

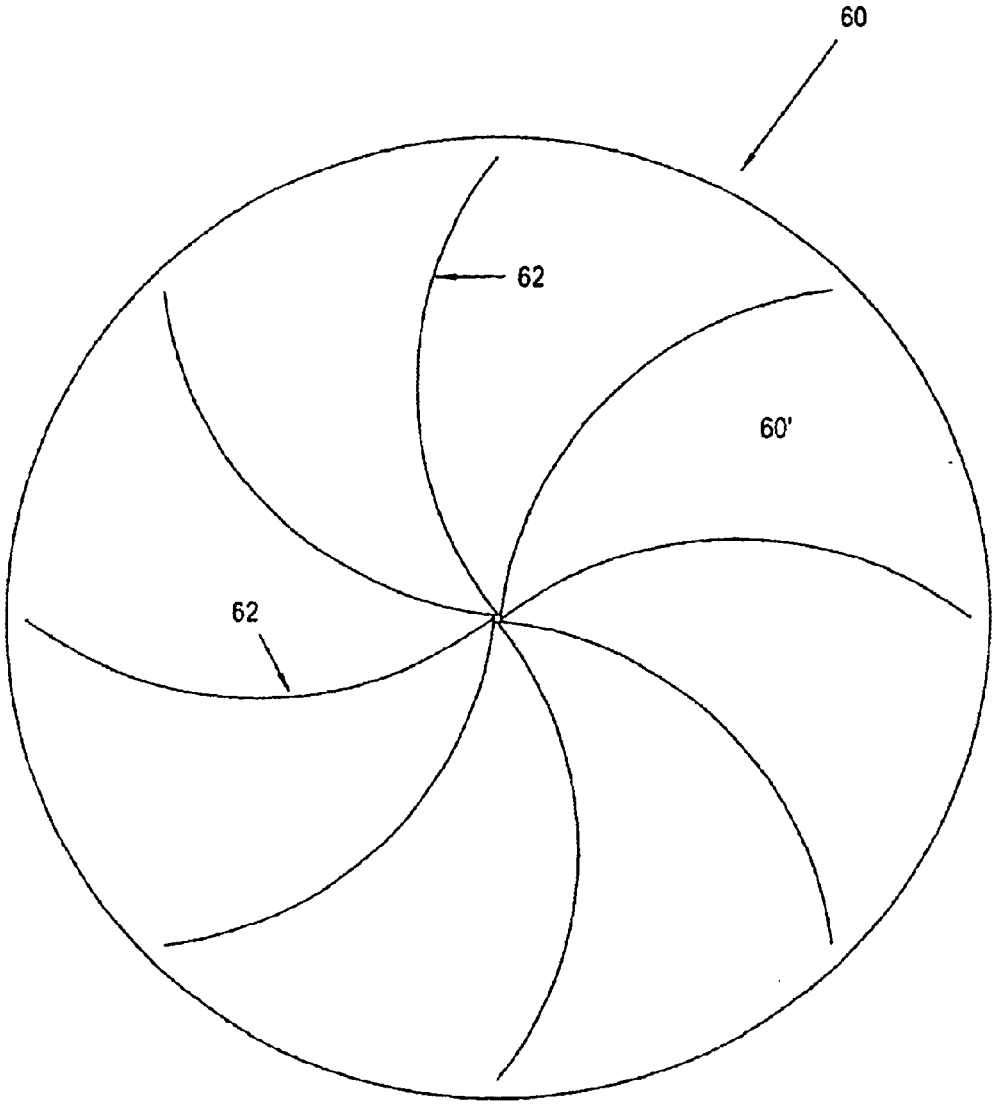
FIG. 5 - PREFERRED GROOVE PATTERN

POLISHING PAD FOR USE IN CHEMICAL-MECHANICAL PLANARIZATION OF SEMICONDUCTOR WAFERS AND METHOD OF MAKING SAME

CROSS REFERENCE TO RELATED APPLICATION

Priority of provision application Ser. No. 60/274,121, filed on Mar. 8, 2001, is herewith claimed.

BACKGROUND OF THE INVENTION

The present invention is directed to a polishing pad for the chemical-mechanical planarization of semiconductor wafers and a method of making it. Semiconductor wafers may have multiple layers of wiring devices on a single wafer. These wiring devices consist of hundreds of electrical circuits fabricated and interconnected in order to produce the computer chips that will eventually be die cut from the wafer. These wiring devices are called integrated circuits (IC). A layer of insulating materials, often silicon dioxide ($S_1O_2$), separate each layer of integrated circuits so that designated IC's interconnect. In order to pack more devices into less space, the requirements for feature size within the IC's has shrunk dramatically. There may now be feature sizes smaller than 0.01 microns. As layers of integrated circuits and insulating layers are deposited, one on the other, it is of utmost importance to maintain the wafer surface on each layer in an extremely flat condition. Features that protrude into another layer and make contact where not intended or do not make contact where intended can cause short circuits, open circuits and other defects that make a valuable product unusable.

The most effective method of polishing and planarizing a multilayer integrated circuit devices is chemical-mechanical planarization (often times called polishing), or CMP. When a layer of metal interconnects or insulation is put down, it must be polished flat; that is, it is planarized before the next layer is deposited. Otherwise, small surface irregularities can cause defects, and an extremely valuable part can be defective and lost. As each layer is deposited and planarized, multiple layers are successfully built up as needed for a particular device.

Chemical-mechanical planarization is superior to previously used technologies because it has proven capable of both local and global planarization of the materials used to build multi-level integrated circuit devices. In this process, a slurry of fine abrasive particles in conjunction with chemicals that attack the surface being polished are used together with a mechanical polishing process to achieve the necessary degree of flatness prior to the deposition of the next layer.

One problem with this approach has been changes in the rate of removal over the life of the polishing pad. Most conventional polishing pads in use at present consist of polyurethane-cast resin; polyurethane fibers are impregnated with polyurethane or a combination thereof. The polishing surface of these pads tends to become glazed and worn over time during the polishing operation on multiple wafers. This changes the pad's surface characteristics sufficiently to cause the polishing performance to deteriorate significantly over time. This has been overcome by conditioning the pad surface during use, or between wafers as needed. This conditioning procedure removes the glazed worn surface from the pad.

The major reason that conventional polyurethane and other thermoplastic-based polishing pads require pad conditioning is that the surface of these pads undergoes plastic deformation during use. This is commonly called creep, and it is a common occurrence when thermoplastic materials are subjected to heat and pressure, however slight. This has been overcome in the semiconductor industry by pad conditioning. Pad conditioning renews the pad surface during polishing operations as required to restore original pad performance whenever this performance falls below acceptable levels. Some operations require continuous pad conditioning, others intermittent, some between wafers. Most semiconductor wafer polishing equipment includes a pad conditioning apparatus built into the equipment. This pad conditioning apparatus generally consists of an arm to which is attached a small rotating disc to which is attached the conditioning pad. This conditioning pad generally consists of fine diamond grit bonded to the bottom surface of a suitable pad material that is attached to the four-inch rotating disc. When needed, the conditioning pad traverses the polishing pad, renewing the polishing pad surface and restoring polishing pad performance. Unfortunately, pad conditioning actually removes material from the polishing pad surface so that over time the polishing pad is slowly ground away, thus shortening the polishing pad's life.

An example of a modern CMP equipment incorporating a conditioning device is shown in FIG. 1. The CMP apparatus 10 of FIG. 1 contains a lower rotating platen to which polishing pad 14 is adhesively attached. An upper rotating member is the wafer carrier 12 where the wafer 13 is retained. The slurry is introduced onto the polishing pad 14 at a point near the center of the pad. A conditioning arm 17 and attached diamond grit conditioning pad 16 traverse the polishing pad 14 in operation for renewing its surface. While this has solved the problem of glazing and subsequent variation in rate of removal, it has introduced a new problem: To wit, the shortening of pad life. Pad conditioning has significantly reduced pad life with the resulting increase in cost of ownership.

The main reasons that polyurethane pads glaze is due to their thermoplastic nature. These materials creep, (deform plastically) under heat and pressure. Even though the heat and pressures involved in CMP are not high, the thermoplastic materials will flow at the surface over time. In addition, abrasive particles from the slurry and polishing debris embed themselves into the soft surface of the thermoplastic polishing pad, creating a glazed surface that no longer retains its original polishing characteristics. Pad conditioning overcomes this at the expense of pad life.

Another problem inherent with pad conditioning systems is the cost of maintenance, and the cost of the diamond grit conditioning pads. In addition, diamond particles sometimes come loose from the conditioning pad and cause scratches on the wafer that cannot be repaired, adding substantially to the cost of ownership. Since pad conditioning reduces pad life and increases time lost for frequent pad-replacement, it is obvious that eliminating the need for pad conditioning with the attendant reduction in cost of ownership is a very desirable goal.

SUMMARY OF THE INVENTION

It is, therefore, the primary objective of the present invention to provide a novel polishing pad for chemical mechanical planarization of semiconductor wafers and similar materials that eliminates the need for pad conditioning.

It is also a primary objective of the present invention to provide a method of manufacture of such a polishing pad.

The polishing pad for chemical mechanical planarization of semiconductor wafers and similar materials of the invention eliminates the need for the pad conditioning required of prior-art polishing pads. The polishing pad of the present invention does not undergo plastic deformation during use, and retains its original polishing characteristics, thus extending life of the polishing pad.

The polishing pad of the present invention requires a thermoset resin for binding fibers to form an impregnated, porous structure. The thermoset resin may be phenol-formaldehyde resin (commonly called phenolic resin.) It is a thermoset resin that when sufficient heat and temperature is applied, a three dimensional structure is formed that is much more resistant to creep (plastic deformation) than are thermoplastic materials, such as polyurethane.

The porous structure of the pad of the invention is preferably paper based, and is created in a wet laid process in which fibers, and any other necessary or desired materials and chemicals, are mixed in a slurry, then deposited on a moving wire or screen, followed by water-removal, which produces an intertwined fibrous material. The fibrous materials used in the polishing pad of the invention is porous, is a three dimensional structure, and, when dried, can be impregnated with various materials, including thermoset resins. The preferred impregnant is phenolic resin.

Another feature of polishing pad of the invention is its polishing surface. In prior art processes, where diamond grit conditioning pads traverse the surface of a polishing pad, material is actually removed from the polishing pad surface. Random surface asperities are created on the polishing pad's surface. The creation of surface asperities at the same time creates random flow channels around these surface asperities that significantly improves polishing slurry distribution. Pad conditioning is a type of surface grinding. In the polishing pad of the present invention, the polishing pad's surface or surfaces are ground when the pad is first produced. Because of the polishing pad of the invention uses a thermoset phenolic resin, this structure containing asperities is retained even after continuous polishing. Surface asperities of at least 10 microns in height, width or length have shown excellent performance results.

The polishing pad of the present invention may also be provided with grooves of various types which augment slurry distribution. Arc radial grooves are particularly effective. The groove does not go through to the outside diameter of the pad in order to prevent slurry from being transported off the pad.

The porous nature of the polishing pad of the present invention also provides spaces or interstices in which used slurry and polishing debris are stored, which are subsequently rinsed away when necessary or desired, in order to further enhance the effectiveness of the polishing operation.

BRIEF DESCRIPTION OF THE DRAWINGS

The invention will be more readily understood with reference to the accompanying drawings, wherein:

FIG. 3 is a multi-head CMP machine where wafers are typically loaded into the loading station from where they are transferred to polishing head and polished at a first station by the polishing pad of the present invention and made by the process of the present invention, and thence to a second polishing head and buffed, and thence into the cleaning station and cleaned and thence unloaded;

FIG. 4 is a plan view showing the process used in the present invention for making a polishing pad of the present invention using cellulose fibers and a thermoset resin; and FIG. 5 is a plan view showing an arc radial groove pattern formed in the polishing pad surface of the present invention, which significantly augments slurry distribution in the polishing pad.

DETAILED DESCRIPTION OF THE INVENTION

The polishing pad for polishing or planarizing semiconductor wafers and similar materials of the present invention is a three dimensional, porous fiber structure that is impregnated and bound together with a thermoset resin that is creep-resistant, and ground on one or both surfaces thereof in order to produce asperities therein. The polishing pad's asperities may be in the range of between 5 and 50 microns, with a preferred range of between 10 and 25 microns. These asperities provide random flow channels for the flow therein of polishing slurry. The surface may also be grooved in order to enhance the flow of the polishing slurry.

The polishing pad is a matrix of absorbent fibers impregnated with a thermoset resin, preferably phenolic, is densified, grooved, if required, and cured to provide a rigid, yet porous structure. Other thermoset resins may be used, such as silicones, epoxies, blends thereof, and the like. The fibers that may be used are: natural or synthetic including cellulose, wood pulp, "ARAMID", rayon, linen, carbon, graphite, polyamide fiber, polymer fiber, lyocell fiber, engineered fibers, etc, and combinations thereof. The cross-sectional diameters of the fibers may be between preferably 10 and 50 microns, with a preferred range of between 15–35 microns. The length is preferably in the range of between 0.4 and 1.3 mm, although it is to be understood that fiber-lengths somewhat shorter or longer may be used effectively. One or both surfaces are then ground to create asperities for forming a polishing surface with random flow channels for optimum distribution of the polishing slurries used in chemical mechanical planarization of semiconductor wafers. The pad of the present invention may be used for polishing, lapping or grinding of other products as well. The term polishing pad is intended to refer to all these types of use. The fibrous matrix constitutes approximately 30–80% by weight of the pad.

Figures 1A, 1B:
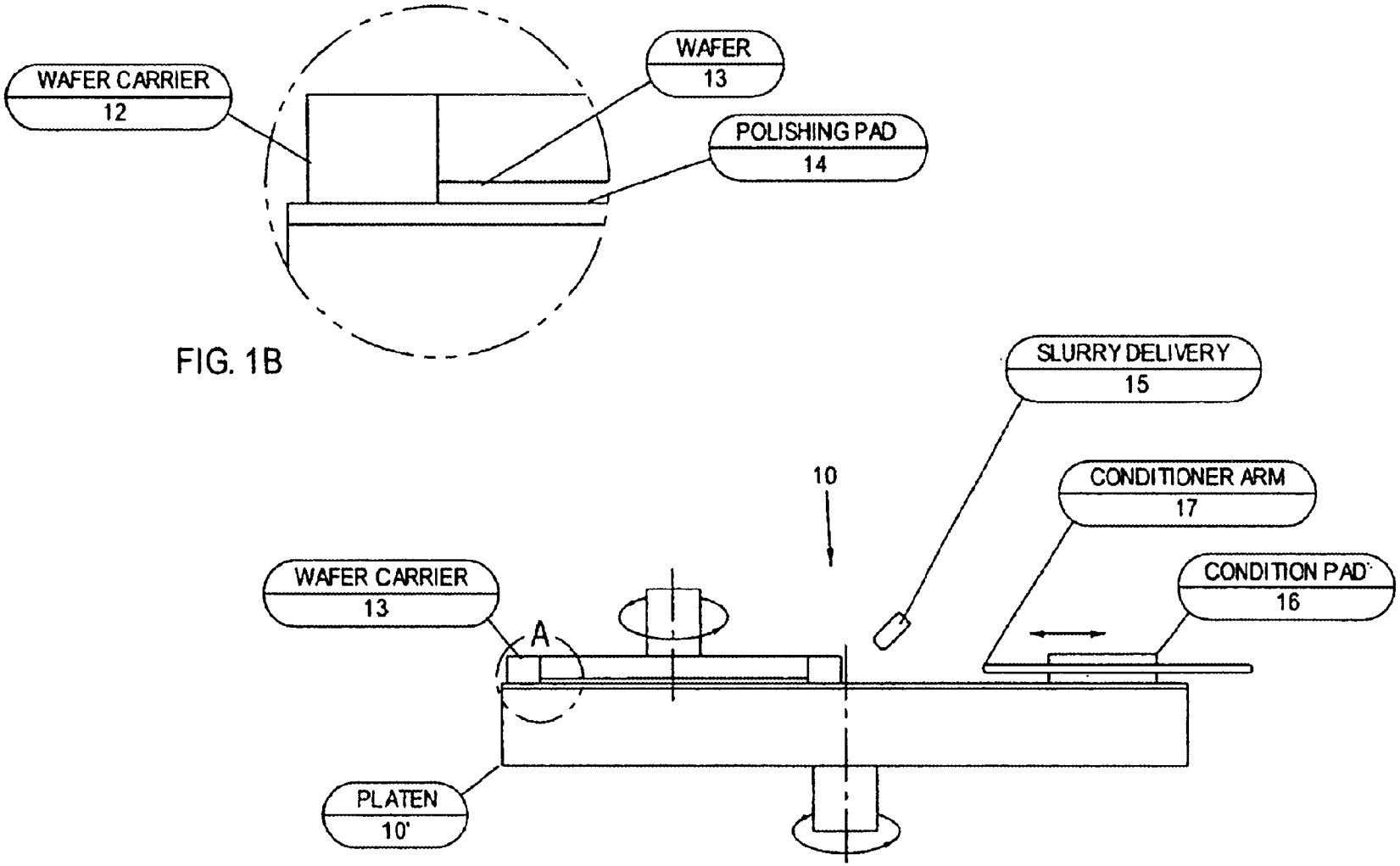
FIG. 1A is a plan view showing a conventional rotational chemical mechanical-planarization apparatus for polishing wafers with a polishing pad, which apparatus also utilizes a diamond grit conditioning pad 6 for periodically renewing the surface of the polishing pad.
FIG. 1B is a detailed view of FIG. 1A showing in enlarged form the polishing pad and wafer interface.
Figures 2A, 2B:
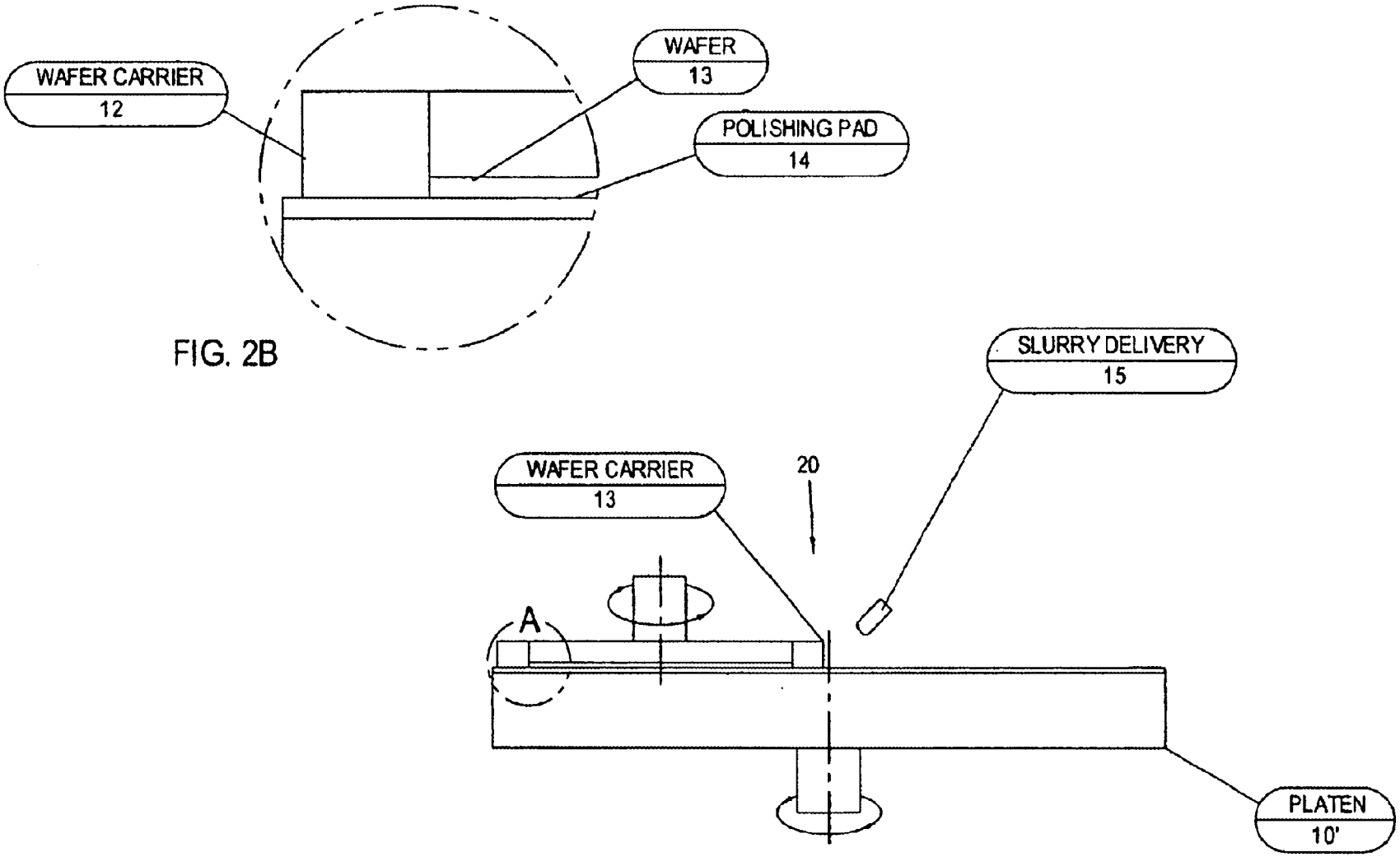
FIGS. 2A and 2B are similar to FIGS. 1A and 1B, but showing a CMP apparatus using a polishing pad of the present invention made by the process of the present invention without the conditioning arm and conditioning pad.

The cellulose matrix of the pad is produced on a paper machine, such as, but not limited to, an inclined wire type. Latex rubber emulsions are typically added, but not required, during the paper making processes for two purposes: To provide wet strength for later resin-impregnation, and to better retain any particulate matter that is part of the paper formulation. In the case of cellulose based paper products that are used in CMP, an increased amount of latex can also provide improved resistance to water. An equivalent of latex may be used, such as acrylic-based chemicals, and the like. When being used in CMP, the pad is exposed to continuous immersion in water which causes cellulose to swell. Additionally, other fillers and chemicals that impart more water resistance and/or wet strength to the cellulose fiber may be added during the papermaking process. Polishing aids and other particulate materials may be added in the paper making process, or in the resin as it is impregnated into the fibrous sheet. Such additives may include polishing aids such as abrasives, friction enhancers, wear particles, and the like. The thermoset resin may also be added to the fiber matrix during the papermaking process, and then subsequently distributed and cured throughout the matrix with heat. The thermoset resin may be added in solid or beater form. The porous fibrous polishing pad is ground to produce asperities preferably in a range of between 10 and 25 microns. Referring to FIGS. 2A and 2B, there is shown a CMP apparatus 20 similar to that of FIGS. 1A and 1B, which utilizes the polishing pad of the present invention, whereby the CMP apparatus does not include, nor require, a conditioning arm and conditioning pad.

Referring to FIG. 3, there is shown a multi-head CMP machine 40 where wafers are typically loaded into a loading 42 station from where they are transferred to a first polishing head 44 incorporating the polishing pad of the invention, and thence to a second polishing head incorporating the polishing pad of the invention, and thence to a cleaning station 48 for cleaning and for offloading.

The manufacture of the fibrous-matrix polishing pad of the invention is accomplished by a wet-laid specialty papermaking process. Specialty paper making differs from the manufacture of such high volume items as news print, paper bags, tissue paper, and other high speed processes in that specialty papermaking is generally a slower and more flexible process, whereby a wider variety of raw materials may be utilized to produce a wide variety of products. Friction materials and filtration materials are two good examples of products produced in a specialty paper mill. Basic, wet-laid paper machine designs include fourdrinier, rotoformer, twin wire former, inclined wire, and hand sheet mold. The polishing pad of the present invention have been produced on an inclined wire, fourdrinier and hand sheet molds. Various types of air or dry-laid production equipment may also be used to produce a satisfactory fiber matrix polishing pad of the invention. Dry-laid machine designs include carding, felting, needle punch, woven, and spun-bond. Dry laid fiber products can be impregnated with latex by several means, and then may be impregnated with thermoset resins in the same ways as the wet laid.

An example of the wet-laid production process is shown in FIG. 4. A suitable source of cellulose fiber is added to a hydro-pulper 50, or beater, that disperses the fibers in water to form a fiber slurry. A dilute mixture of latex, or the equivalent thereof, is then preferably added to the slurry and allowed to uniformly mix into the slurry. Chemicals that have a high cationic charge, or donate positive ions, are then added slowly to the slurry to precipitate or coagulate the latex onto the fibers. Alternately, a pre-cationized latex, which will adhere onto the fibers immediately upon addition may be used. If any particulate fillers are to be added, they are generally added prior to the latex addition. Other paper making chemicals, such as wet strength resins, retention aids, surfactants, sizing agents, or pigments may be added either to the pulper or subsequently to the stock prior to forming the sheet. After complete mixing, the slurry is dumped into a stock chest 52, where additional water is added to reach an ideal solids content for paper-making. At this point, the dilute slurry is then pumped to the paper machine where it is further diluted in-line with water, whereupon it enters the headbox 53 and is distributed onto a moving wire or screen 55. Water is removed from the stock through the wire by gravity and vacuum 57, thus forming a continuous sheet. The wet sheet is densified through a conventional press roll (not shown), and then dried through an oven or oven-dryer cans. This process produces a soft, compliant, non-brittle, and fairly flexible material. Deionized (D1) water is preferably used throughout the process for purity, although softened water may been used successfully, and any source of water that is free of harmful contaminants may be satisfactory.

In a manner similar to that described above, a composite material can be produced through utilizing a dual headbox paper machine system. While the bottom layer sheet is forming, a second sheet is formed and laid on top of the bottom sheet. Both sheets are brought together while they are very wet. This process produces a material that has two or more different layers, bound together at the interface by entanglement of the fibers and/or other ingredients used. The different layers may have different porosity, density, or even different formulations. Sprinkling, or laying other materials, such as fibers, fillers, or another web of dry material, on top of the wet slurry while it is being formed on the wire may also produce this composite type of product without the use of two headboxes.

The dried fibrous, raw mat or sheet is then impregnated with a thermoset resin via a saturation process. This is done with the raw sheet in blanked pad form, sheeted form, or roll form. The solids-content of the resin is adjusted using a solvent. This controls the amount of resin that is absorbed into the raw sheet. In the processing of high-density materials, it may be desirable to utilize a hard roll squeeze nip to press the resin into the sheet in order to ensure resin penetration into the center of the material. The resin-wet material then travels through a sponge-gap wiper roll to remove excess resin from the surfaces, and then into an oven to remove the majority of the solvent. The time and temperature in the oven are adjustable in order to effectively remove the desired amount of solvent and leave the resin uniformly impregnated in the matrix of the material. If desired, the material may be either partially cured (commonly called B-staged), or fully cured when passing through the oven. The curing process uses heat to harden and set the resin in the matrix of the material; hence, the name thermoset resin. If densification or press-in grooving is required, the material is usually B-staged, allowing the resin to still flow under heat and pressure. This allows the material to be molded to the desired density, thickness and groove pattern. B-staged pads are densified and sized by either a press or calendaring process. If grooves are required, the densification and grooving process are done in one step with a hot platen press and a groove fixture. The grooves are pressed into the B-stage material while it is being densified in the press. Alternatively, grooves may be formed into cured or B-staged material through embossing, grinding, or cutting. The pressed and/or grooved B-staged material is then fully cured in an oven at a set time and temperature that ensures a full cure of the resin. It is also possible to complete the cure in the densifying/grooving operation. Cured material, if not done before impregnation, is then blanked to the desired pad dimensions. This blanking process may include a small area that is blanked out for CMP endpoint detection methods. The pads are then ground to final size on an appropriate grinder. Either one side or both sides of the pads may be ground. Grinding both sides has the advantage of controlling final thickness to a tighter tolerance. Grinding of the pad surfaces creates a polishing surface with random flow channels for optimum distribution of the polishing slurries used in chemical mechanical planarization of semiconductor wafers. These flow channels, when combined with the porous nature of the pad, create the optimum environment for distribution of the polishing slurry during the polishing process, and also of disposal of polishing debris formed by the removal of material from the part being polished. Polishing debris and used slurry are stored within the porous matrix of the pad and rinsed away later, as between wafers for instance. This allows the fresh slurry that is continually being added to be more effective in polishing of the wafer. Differing grinding grit sizes may be used to create various-sized asperities as required for effective polishing of different materials. Random asperities of between 10 microns to 25 microns in depth, height, width and/or length from the plane of the polishing pad surface results in maximum removal rate of some substrates, such as tungsten, while yielding satisfactory planarity of the substrates surface. Ground surfaces created by two 90 degree passes is more effective than one in which the grinding is completely circular and more random. The polishing are then cleaned to remove any grinding debris. A pressure sensitive adhesive, approved for the CMP process, is then applied to the back, ungrooved side, of each pad.

"Wet-Laid Process"

Suitable sources of cellulose fiber that may be used include cotton linters and wood pulp, such as hardwood and softwood. The cotton linters, at a low contamination level, are preferred. The fibers and any desired fillers, such as talc, diatomaceous earth, friction particles, or colliodal silica, may be added to the pulper with deionized water and completely blended. In some cases, fillers are not used in the material. Once the fibers and fillers are completely blended, a latex emulsion is then added to the pulper and completely blended into the slurry. The latex content has been varied between 5% and 75% of the entire dry material weight. Latex in the lower addition range is currently preferred. The latex is then precipitated onto the fibers by adding papermakers' alum or a cationic polymer. The use of a cationic polymer is, however, preferred. The latex and fibers are usually negatively charged; therefore, the additional of a cationic ions forms a bridge between latex and fiber and also allows the latex to precipitate or coagulate together, thus coating the fibers and fillers. The slurry is then pumped or gravity-dropped to a stock tank where it is diluted with additional deionized water. The amount of this dilution is system-dependent. If required, additional chemicals that give the material wet strength and/or protection against water are added to the stock tank or in-line before the headbox. Chemicals used may include wet strength resins and sizing agents. The addition of chemicals and the type of chemicals used depend on the end use of the pad. Various types of semiconductor CMP processes require different pad properties.

The slurry is then combined with additional DI water in-line and pumped to the headbox where the sheet initially forms. The raw sheet is formed on an incline wire machine, a Fourdrinier paper machine, or in a hand sheet mold, which is a stationary wire. All types of paper machines, i.e. rotoformer, twin wire, etc. would produce an acceptable raw sheet. The sheet is densified in the press section of the paper machine while it is still wet. Density ranges may vary between 0.200 g/cc to 0.750 g/cc. The higher density range is currently preferred because it yields a more durable product. The wet material is then dried using hot air, hot dryer cans, or IR (infrared) dryers. Both a hot air oven and dryer cans have been used successfully. In some cases, the material is partially dried, then further densified in another press section before being completely dried. Material has also been impregnated with paper making chemicals, such as sizing agents and/or colloidal silica in the size press section of the paper machine. This allows surface coating and/or improved retention of small particles that can be lost through drainage on the wire. Some polishing aids can be mixed with the resin and added later in the resin impregnation step. The dry raw sheet is then either sheeted into large squares or blanked to the desired pad diameter. If pad diameter is critical (less than +/−1 inch), then the material is usually sheeted and blanked to size after resin impregnation and B-staging. This eliminates the effect of material shrinking or expanding during the resin impregnation and curing processes. The resin impregnation process is done by either soaking the material in a bath of resin, or by feeding the material through liquid curtains of resin. The presently preferred resin is a thermoset phenolic resin. However; polishing pads have been successful with silicone, epoxy, and modified epoxy resins, or blends thereof. Pads containing at least 20% resin-content have been used in the CMP process. High resin-content results in a more rigid and brittle material. Less resin results in a softer, more compliant material. More resin in the material aids in protection of the fiber matrix during the CMP process and can positively affect uniformity, yet adversely affect the rate of removal in the CMP process. A low to midrange resin content is currently used in most pad production.

The resin-wet sheet or pad is then passed through sponge wiper rolls and then through an oven to drive off the solvents used with the resin. Oven time and temperatures vary depending on the type of resin used, amount of resin in the material, and degree of resin cure desired. Typical temperatures may range from 100 F. to 450 F., and the oven may have zones of various temperatures as the material travels through it. If the resin is not fully cured in this oven, it is termed B-staged. B-staged resin will still flow within the matrix of the material when heat and pressure are added. This allows the material to be compressed under heat to an extremely low void-volume if desired. It also allows a groove pattern to be pressed into the material with a specially designed mold, if desired. If the material is in sheet form, the pads are usually blanked to specified dimensions while in B-staged form.

Depending on the CMP application, pads have been produced at approximately 15% void volume to approximately 65% void volume. The groove pattern has varied from circumferential grooves, radial grooves, arc radial grooves, and combinations thereof. The number of grooves on the pads has varied from approximately 90% of the pad surface to no groove at all on the pad surface. The majority of the pads are 40% to 50% void volume with approximately 8 to 12 arc radial grooves to aid in slurry transport and wafer de-chuck during the CMP process.

Pressing and grooving are typically done in one operation with a hot platen press. Temperature of the platen is usually set at or below the temperature the pads received during the B-stage process. Once the B-stage pads have been compressed and grooved, they are fully cured in an oven. Oven time and temperature again varies with the type and amount of resin used, as well as the thickness and area of the pads themselves. The final cure can be achieved in the pressing/grooving operation if so desired.

Fully cured pads are then ground on one or both sides of the pad, depending on the CMP application. Grinding is generally done in order to: Remove any resin-rich surfaces due to resin migration; open the matrix of the pad so it will readily absorb slurry; achieve the desired planarity; and produce an optimal surface with flow channels for wafer polishing. Pads have been ground on a stone-disk Blanchard grinder, but a majority of the pads are ground using a belt type Curtin-Hebert grinder. Approximately 0.015–0.020 inches are removed from the pad surfaces to achieve the desired characteristics. Various grit sizes are also used to achieve the desired performance in the CMP process by producing surface asperities/slurry flow channels of differing dimensions.

One example of a polishing pad of the invention made is as follows. Cotton linters and approximately 10% latex were mixed in a pulper with deionized water. A cationic polymer was used to precipitate the latex onto the fibers. A sheet was then formed from this slurry on an incline wire paper machine. The raw material was produced at approximately 435-lbs/3000 ft2 basis weight, which is a common paper industry specification. The raw material web was cut into sheets approximately 23 inches square. Next, 20 inch diameter circular pads were blanked out of the raw sheets. The raw pads were then dried to remove any excess moisture. The dry pads were then soaked in a bath of phenolic resin until fully saturated. Adding ethanol to the resin prior to saturating the pads controlled resin concentration. This resulted in approximately 12% to 18% resin volume in the pads. The pads were then B-staged in a two-zone oven at 250 F./300 F. for approximately 10 minutes. The B-staged pads were then hot pressed and grooved with a groove fixture in a platen press at 300 F for 2 minutes. Pressed thickness was controlled by stops or shims in the press. Approximately 10% compression was achieved in the pressing operation and eight arc radial grooves were pressed into the pads. FIG. 5 shows such an arc radial groove pattern 62 formed in the surface 60' of the polishing pad 60 of the present invention, which significantly augments slurry distribution in the polishing pad.

The pressed, B-staged pads were then fully cured in an oven for 2.5 hours using a ramp cycle to 350 F. The cured pads had a final density of approximately 0.610 g/cc and a void volume of approximately 51%. The cured pads were then ground on a Curtin-Hebert belt grinder with a 60 grit belt. Approximately 0.015 inches of material was removed from the working surface (grooved side) of the pads and approximately 0.008 inches of material was removed from the back of the pads. An approved pressure sensitive adhesive was then applied to the back of the pad. The final product thickness was approximately 0.050 inches including adhesive, and groove depth was approximately 0.014 inches deep. Grinding of both sides of the pad can help to produce more uniformly thick pads. Pad uniformity increases the amount of surface in contact with the substrate being polished and thus can increase rates of removal.

This type of pad has polished approximately 1500 wafers @ 4 psi without failure and without pad conditioning. It had a good rate of removal, as well as acceptable wafer non-uniformity.

While specific embodiments of the invention have been shown and described, it is to be understood that numerous changes and modifications may be made therein without departing from the scope and spirit of the invention as set forth in the appended claims.

What we claim is:

1. A process of making polishing pads for use in chemical mechanical polishing of substrates, each said polishing pad having a ground polishing surface and consisting of a porous fibrous matrix of paper-making fibers, fillers, and a binder for binding said fibrous matrix, said binder consisting of thermoset resin, said matrix and said binder forming a porous structure by which polishing slurry or polishing debris during chemical mechanical polishing of substrates are temporarily stored for subsequent rinsing away and for enhanced flow-distribution of the polishing slurry; said ground polishing surface consisting of a ground surface in order that said matrix thereat is of open-pore construction and defines surface asperities by which said optimal distribution of polishing slurry during chemical mechanical polishing of substrates is achieved, so that polishing slurry may be readily absorbed and optimally distributed during chemical mechanical polishing of substrate, said polishing pads being made by a process comprising:

(a) making said polishing pads using a wet-laid paper-making process;

(b) said step (a) comprising forming a slurry of at least water, paper-making fibers, and latex;

(c) mixing said slurry of said step (b) in order to disperse the fibers;

(d) delivering said mixed slurry to a paper-making apparatus, and forming a wet-laid sheet;

(e) drying the wet-laid sheet of said step (d);

(f) adding thermoset resin binder;

(g) said step (f) comprising at least one of: adding the thermoset resin during said step (b), and after said step (e);

(h) curing the sheet;

(i) cutting the sheet to form polishing pads of desired size;

(j) grinding at least one surface face of each said polishing pad to form said asperities and to open the porous matrix for polishing slurry transport during CMP processes.

* * * * *